US008001757B2

(12) United States Patent
Eichelmann et al.

(10) Patent No.: US 8,001,757 B2
(45) Date of Patent: Aug. 23, 2011

(54) DOUBLE-TWIST BUNCHING MACHINE

(76) Inventors: Larissa Eichelmann, Teltow (DE); Klaus Eichelmann, Teltow (DE)

( * ) Notice: Subject to any disclaimer, the term of this patent is extended or adjusted under 35 U.S.C. 154(b) by 50 days.

(21) Appl. No.: 12/601,897

(22) PCT Filed: May 28, 2008

(86) PCT No.: PCT/EP2008/004210

§ 371 (c)(1),
(2), (4) Date: Nov. 25, 2009

(87) PCT Pub. No.: WO2008/145344

PCT Pub. Date: Dec. 4, 2008

(65) Prior Publication Data

US 2010/0170213 A1 Jul. 8, 2010

(30) Foreign Application Priority Data

May 31, 2007 (DE) ..... 10 2007 025 538

(51) Int. Cl.
*D01H 7/24* (2006.01)

(52) U.S. Cl. ..... 57/58.63; 57/58.83

(58) Field of Classification Search ..... 57/58.36, 57/58.38, 58.52, 58.63, 58.83
See application file for complete search history.

(56) References Cited

U.S. PATENT DOCUMENTS 3,786,623 A 1/1974 Eliasson
3,824,775 A 7/1974 Birch
5,118,278 A * 6/1992 Nishijima et al. ..... 425/500
5,147,662 A * 9/1992 Nishijima et al. ..... 425/500
6,295,798 B1 * 10/2001 Bae et al. ..... 57/58.63
6,327,843 B1 * 12/2001 Cipparrone et al. ..... 57/3

FOREIGN PATENT DOCUMENTS

DE 33 47 739 A1 7/1985
JP 55-116890 A 9/1980
JP 2-014086 A 1/1990
JP 2-293482 A1 12/1990
JP 2006-283249 A 10/2006

OTHER PUBLICATIONS

International Preliminary Report on Patentability, dated Jan. 12, 2010, from International Application No. PCT/ EP2008/004210, filed on May 28, 2008.

Search Report mailed Sep. 15, 2008, from International Application No. PCT/EP2008/004210, filed on May 28, 2008.

* cited by examiner

*Primary Examiner* — Shaun R Hurley
(74) *Attorney, Agent, or Firm* — Houston Eliseeva LLP

(57) ABSTRACT

The invention relates to a double-twist bunching machine for producing bunched strand material (14), in particular wires, with an inlet (17) for individual strands (12) which can be supplied to a first deflection point (18) which has a first deflection roller (19), wherein the first deflection roller (19) is arranged in a manner such that it can rotate about an axis of rotation (21) in order to form a first twist, with a hoop (24) which rotates about the axis of rotation (21) and connects the first deflection point (18) to a second deflection point (26), wherein the second deflection point (26) has at least one second deflection roller (32) which is rotatable about the axis of rotation (21) in order to form a second twist.

22 Claims, 4 Drawing Sheets

DOUBLE-TWIST BUNCHING MACHINE

Figure 1:
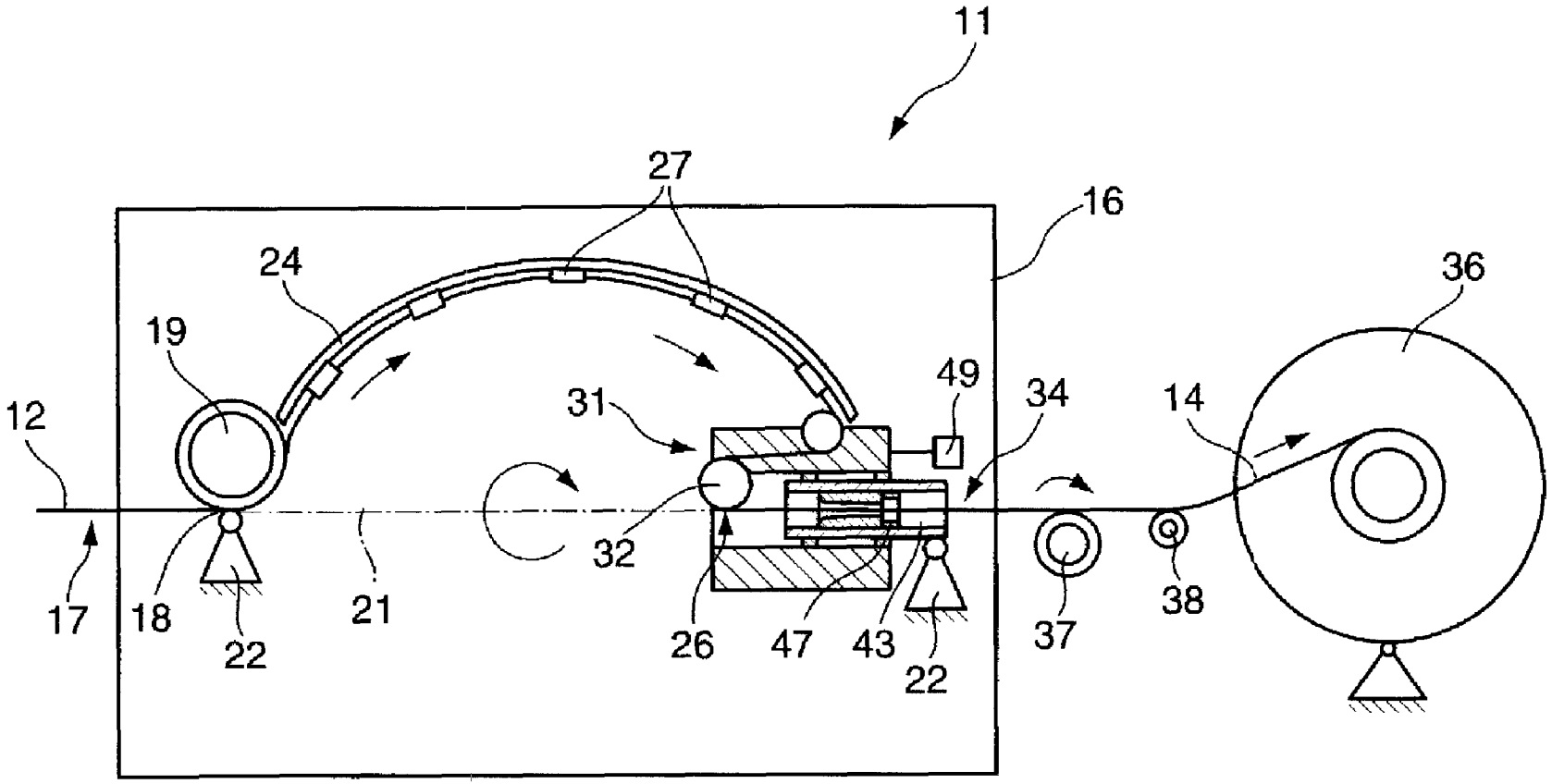

A double-twist bunching machine designed for bunching individual strands into a bunched strand material or into a stranded wire is known from DE 35 00 949 A1. Via an inlet of the bunching machine, the individual strands are supplied to a first deflection point. A deflection roller is provided on this first deflection point so as to guide the supplied individual strands along a rotating bow which leads to a second deflection point. At this second deflection point a deflection roller is provided in order to guide the strand material to a region or range of rotation of the rotating bow, in which a spool for taking up the bunched strand material is provided. The first and second deflection rollers in the first and second deflection points lie in an axis of rotation of the bow. This makes it possible to achieve a first twist at the first deflection point and a second twist at the second deflection point for twisting the individual strands in order to bunch the individual strands into a strand material.

A double-twist bunching machine of this type has the disadvantage that the storage volume of the spools for the bunched strand material is limited by the range of rotation occupied by the bow. Although with the use of very large rotating bows and small diameters of strands it is possible to achieve a high storing capacity of the spools, the number of twists and, consequently, the operating speed of the double-twist bunching machine is thus reduced due to the bow, which has to be formed with greater dimensions. Owing to the increased inert mass, the rotational speed drops. If the rotating bow is formed with a small form factor, the storing volume of the spools decreases, such that a greater number of downtimes is necessary for swapping spools. In both cases, the productivity of the double-twist bunching machine will be reduced.

A bunching machine designed for bunching individual strands is known from DE 33 47 793 A1. With this bunching machine, the take-up spool for the bunched strand material is provided outside the range of rotation of a bunching rotor, so that the size of the bow is not determined by the storing volume of the spools. This bunching rotor comprises a housing in which rotating rollers are provided such that on rotating the bunching rotor the strand material is guided along the rollers. Downstream of this stranding rotor, a pair of rollers is arranged which is connected with the first stranding rotor by means of a gear assembly. For bunching the individual wires, the stranding rotor is designed to work with a single rotational speed and the separate pair of stranding rollers which is arranged downstream thereof are designed to rotate with double rotational speed with respect to the first stranding rotor. Thus, a compound stranding is achieved. This apparatus has the disadvantage that the different rotational speeds and an interposed gearing lead to a complex structural design. In addition, this necessitates a considerable installation space. Furthermore, in an assembly having a constructive design of this type, the double rotational speed of the pair of stranding rollers situated and operating outside of the stranding rotor will limit the processing speed.

It is therefore an object of the invention to provide a double-twist bunching machine which allows a high processing speed or high twist numbers that are, to an extent as great as possible, independent of the spool size or spool storage volume and of the strand cross-section.

This object is achieved according to the invention by the characteristics of a double-twist bunching machine for fabricating bunched strand material having an inlet for individual strands which are supplied to a first deflection point that has a first deflection roller, the first deflection roller being arranged so as to be rotatable around an axis of rotation for forming a first twist, a bow rotating about the axis of rotation and connecting the first deflection point with a second deflection point, the second deflection point having at least one second deflection roller that is rotatable about the axis of rotation for forming a second twist, and a spool onto which the bunched strand material is wound and which is arranged outside the range of rotation of the bow, wherein the second deflection roller and at least one further deflection roller, which is assigned to the second deflection roller, form a deflection device mounted in pairs in a manner such that they can rotate about the axis of rotation, and wherein a supply point for the strand material is provided on the further deflection roller which lies between the second and the at least one further deflection rollers, and a pull-off point of the strand material is provided on the second deflection roller which lies in the second deflection point on the axis of rotation, and wherein the strand material after having passed the supply point of the further deflection roller twines itself and is supplied to the second deflection roller, the strand material crossing the supply direction to the supply point and twining itself subsequently around the second deflection roller, such that the strand material is guided out of the deflection device at the second deflection point.

Owing to the configuration of a deflection device in the second deflection point which makes it possible for the bunched strand material to be guided in such a manner that after the second twist it leaves the range of rotation of the rotating bow and is supplied to a spool arranged outside the range of rotation of the bow, it is possible to design the size of the rotating bow independently of the storing volume of the spool. Thus it is possible to create bows which are shorter in length so as to allow higher twist numbers. These lead to higher production rates and allow an increased output. At the same time, the utilisation of smaller bows as compared with those used in the prior art double-twist bunching machine permits a considerably lower energy consumption, as the necessary driving power is reduced.

In addition, the expenses due to wear and tear are reduced when smaller bows are used, as these are less expensive in their fabrication and require fewer guide members for the strand material to be bunched. In addition, the configuration according to the invention has the advantage that spools of different dimensions may be used for storing the bunched strand material, that different strand diameters, which may lead to more frequent spool swapping, have no influence on the production time, and that spools may be swapped outside the region where the bunching takes place, without interruption of production.

In addition, this configuration of the deflection device according to the invention, which has at least two deflection rollers aligned in pairs with respect to each other and rotatably mounted around the axis of rotation of the bow, has the advantage that it allows a reliable guiding of the strand material as well as high processing speeds for bunching. In this arrangement, the second deflection roller is designed to be provided with a deflection point lying in the axis of rotation of the bow.

Preferably, the longitudinal axis of the at least one further deflection roller is designed to be arranged parallel with the second deflection roller so as to form a deflection device. This creates simple geometrical relationships allowing, in particular, high rotational speeds, such that a deflection device of this type will not limit the high processing speed which is made possible owing to a rotating bow. Preferably, the axes of rotation of the deflection rollers of the deflection device are oriented perpendicularly to the axis of rotation of the bow. In particular, the axis of rotation of the bow lies between the two longitudinal axes of the deflection rollers.

According to a preferred configuration of the invention, the strand material having passed the supply point leading to the deflection device is designed to twine itself around the at least one further deflection roller, to be subsequently guided towards the second deflection roller, the strand material crossing the supply direction leading to the supply point and then twining itself around the second deflection roller, such that the strand material may be guided out of the deflection device via the take-off point. Preferably, the take-off point lies in the second deflection point. By guiding the strand material around the second and the at least one further deflection rollers of the deflection device, the torsion or twisting of the strand material is enabled. The second and the at least one further deflection rollers are preferably mounted in such a manner as to rotate about their respective longitudinal axes in order to allow high processing speeds.

According to a further advantageous configuration of the invention, the bunched strand material is designed to be guided between the supply point and the take-off point of the deflection device in such a way as to twine itself at least once by a full turn around the at least two deflection rollers. Additionally, the fully twined turn ensures that the bunched strand material is kept from untwisting as it passes the deflection device.

Preferably, a guide roller is assigned to, and arranged upstream of, this deflection device equipped with at least two deflection rollers assigned in pairs to each other, said guide roller guiding the strand material to the deflection device, the guide roller being provided with a lateral offset with respect to the axis of rotation of the bow and supplying the strand material to the supply point of the deflection device which is arranged off-centre. This lateral offset between the take-off point and the supply point, together with the rotation of the at least two deflection rollers, causes the second twist for bunching the strand material. The lateral offset is preferably made to be small in order to keep an unbalanced mass as small as possible, while at the same time it is preferably ensured that the individual turns twined around the deflection rollers are kept separate from one another. These deflection rollers of the deflection device are preferably designed to be at least partially provided with trough-shaped recesses intended to support the guiding of the strand material as it twines itself around the rollers.

According to an alternative configuration of the invention, the double-twist bunching machine is designed to be provided with a deflection device which is located in the end region of the bow in the second deflection point and consists merely of a second deflection roller and the pull-off point of the strand material is designed to lie in the axis of rotation of the bow. This second deflection roller is equally mounted in such a manner as to be rotatable about the axis of rotation, with the first and second deflection rollers being preferably arranged at the same side relative to the axis of rotation and/or being arranged between the axis of rotation and the bow. This embodiment may provide a simplified embodiment of a deflection device as compared to the configuration according to the invention described further above. In this configuration, the second deflection roller is preferably oriented so as to act in the same direction relative to the axis of rotation as the first deflection roller. This means that the direction of one of the distances between the deflection point and the axis of rotation of the first deflection roller is the same as the direction of the distance from the second deflection point to the axis of rotation of the second deflection roller. In the first embodiment according to the invention, this direction of the distance between the spin axis of the deflection roller and the axis of rotation is inverted. Due to this alternative configuration of the invention, which has a deflection device consisting of merely one deflection roller, it is possible to achieve very high processing speeds.

According to a preferred configuration of the invention, the deflection device is designed to have at least one further guide roller which is arranged between the rotating bow and the second deflection roller. This second guide roller allows to change directions when guiding the strand material out of the range of rotation of the rotating bow and/or out of the bunching machine. This guide roller is directly assigned to the rotating bow and first guides a portion of the strand material in a direction leading out of the range of rotation of the bow, before the second deflection roller operates a reversal of direction and, after the formation of the second twist, guides the bunched strand material along the axis of rotation of the rotating bow and out of the range of rotation of the bow. In order to carry out said reversal of direction, the strand material is preferably designed to twine itself around the second deflection roller by an amount ranging between 85° and 275°, before leaving the second deflection roller at the pull-off point.

According to an alternative configuration of the invention, the deflection device is designed to be formed by the rotating bow and the second deflection roller, the second deflection roller being arranged with respect to the rotating bow in such a manner that the strand material supplied via the bow is supplied to the second deflection roller for being directly guided out of the range of rotation of the rotating bow. The introduction of a second twist by the second deflection roller is maintained. This arrangement permits to achieve a reduction of the moving masses.

According to a preferred configuration of the invention, the further deflection roller is designed to be provided with a circumferential, groove-shaped recess arranged on the circumferential surface and having a pitch so as to allow the strand material to twist itself at least once fully around the roller. By this configuration of the deflection roller, this second deflection roller is designed to rotate about the second deflection point and to supply the strand material to be bunched to the second deflection roller with an offset from the axis of rotation. By the fact that the strand material twines itself at least once fully around the roller, a reliable twisting or torsion is achieved. This embodiment has the advantage of having a small number of moving components and thus a small amount of moving mass as well as a small amount of unbalanced mass to be compensated.

According to a further preferred configuration of the invention, the deflection device is designed to have an outlet which lies in the axis of rotation of the first and second deflection points. Thus it is possible to maintain the basic principle of double-twist bunching and to achieve a constructively simple configuration for guiding the bunched strand material out of the range of rotation of the bow and/or out of the bunching machine.

The deflection device preferably has a main body which receives the second deflection roller and to which the rotating bow is releasably attached. Thus, an easy constructive configuration may be achieved. At the same time, the moving masses may be reduced.

The deflection device has a rotary bearing around which the main body is lodged in such a manner that it is rotatable about the axis of rotation of the rotating bow. This rotary bearing is rigidly connected with a machine stand or a machine frame. The rotary bearing is preferably realised in the form of a roller bearing or a plain bearing in order to accommodate the high rotational speeds. The rotary bearing preferably comprises a through hole in order to guide the bunched strand material out of the range of rotation of the bow and towards the outside. The rotary bearing is realised, for example, in the form of a tubular or cylindrical component part having one or several roller bearings, rotary bearings, or plain bearings for accommodating the main body.

The deflection device preferably has a bunching die, slide block, or guide bush that is provided in the rotary bearing in such a manner as to be secured against rotation. Thus is it possible to achieve a controlled guiding of the bunched strand material out of the range of rotation of the bow and/or out of the double-twist bunching machine. Bunching dies of this type prevent the strand material that has been bunched with two twists from untwisting after it has passed the bunching die, thus ensuring that it will maintain its bunched or twisted arrangement.

The bunching die is preferably provided in the deflection device in such a manner as to be replaceable. By means of a stop, a correct positioning thereof can be rapidly and easily achieved. For reasons of frictional wear, this bunching die is preferably made of ceramic, hard metal, ceramic-coated steel, natural or industrial diamond.

On the main body of the deflection device, a driving member is provided which serves for rotatably driving said main body and on which a driving unit is applied. The driving member may be provided in the form of a toothed gear, a crown gear, a pulley, or the like, in order to convey to the driving unit, via a drive motor and, if necessary, a clutch member, the number of revolutions required for attaining its working speed.

Due to the advantageous disposition of the spool outside the range of rotation of the bow, the rotational speed may be set independently of the spool size. Thus, the rotational speed may be adapted to other constructive parameters and to the size of the strand diameter. So far, the rotational speed has been dependent on the spool size, since with very large-sized spools the machine had to be operated at a low rotational speed, taking into account the action of the occurring centrifugal forces.

Figure 2:
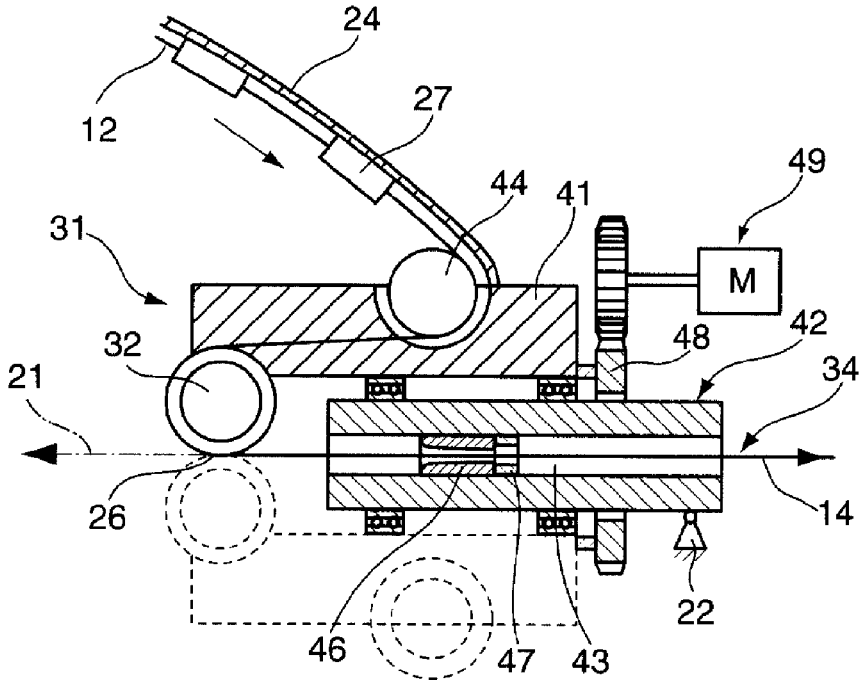
Figure 3:
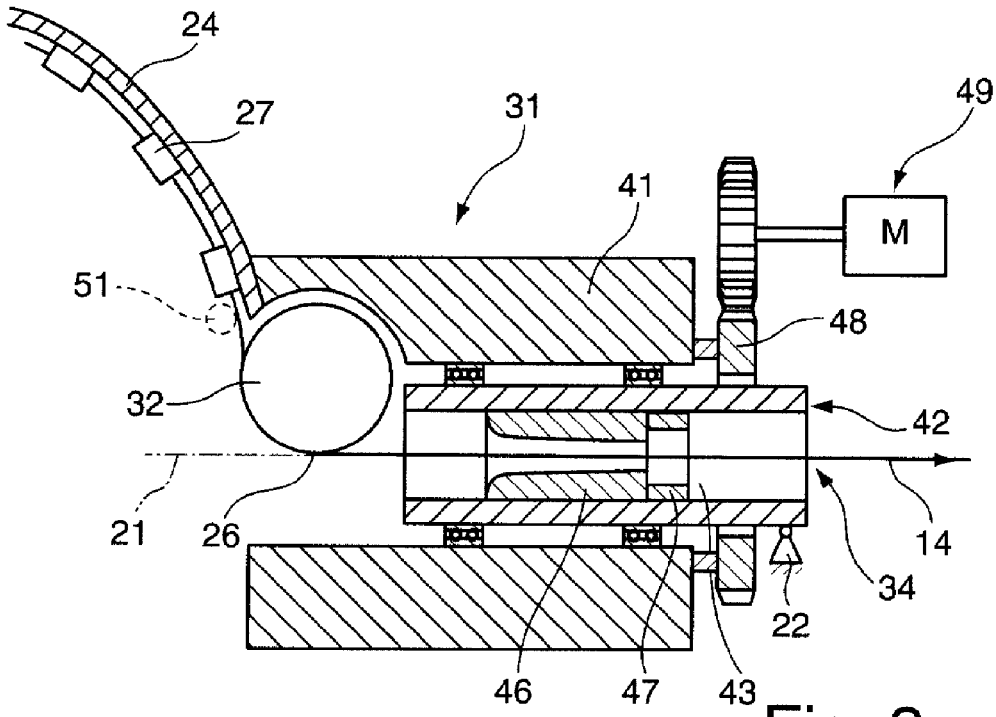
Figure 4:
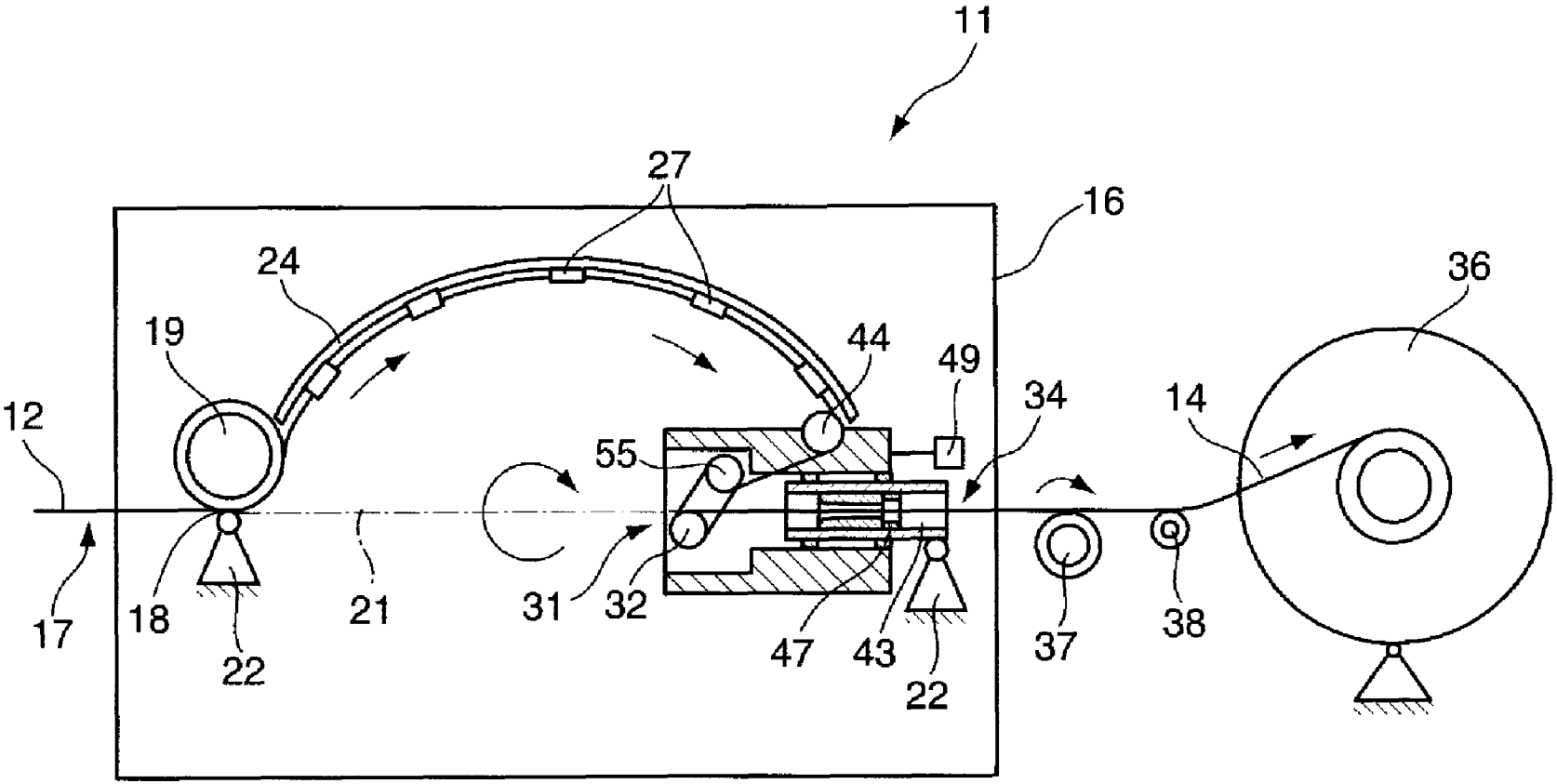
Figure 5:
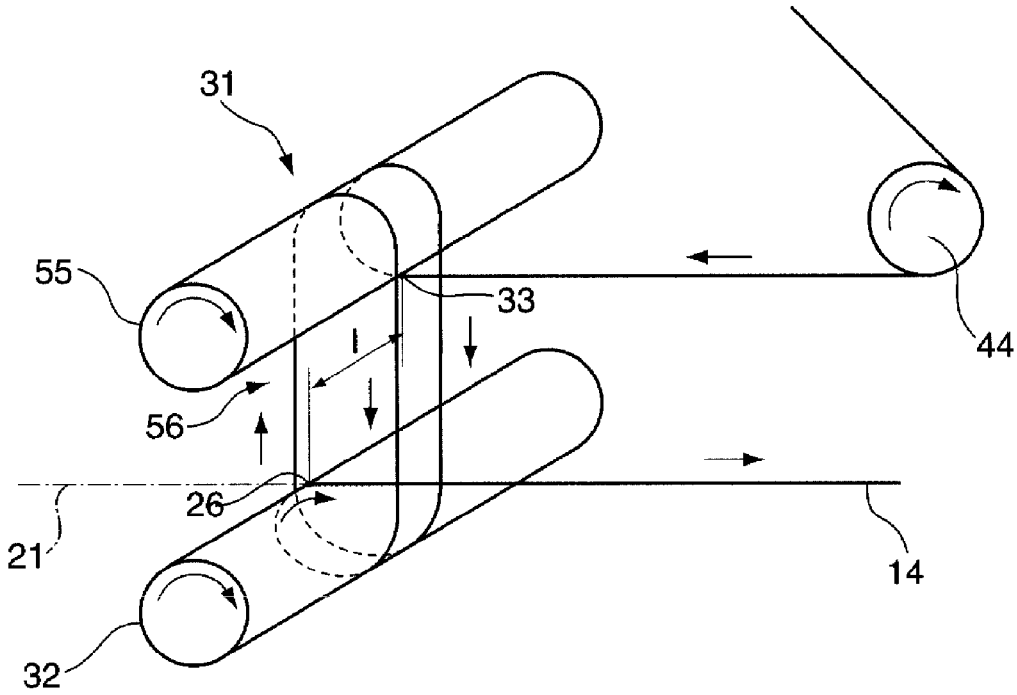

The invention, as well as other advantageous embodiments and developments thereof, will be described and explained in the following with reference being made to the examples shown in the drawings. The characteristics issuing from the description and the drawings may be applied according to the present invention either individually or as a plurality of features taken in any combination. In the drawings:

FIG. 1 is a schematic view of the double-twist bunching machine of the present invention, FIG. 2 is a schematically enlarged view of a deflection device for guiding the bunched strand material out of the double-twist bunching machine, FIG. 3 is an alternative embodiment of a deflection device, different from that of FIG. 2, FIG. 4 is a schematic view of another double-twist bunching machine according to the invention, and FIG. 5 is a schematic, enlarged view of a deflection device of the double-twist bunching machine according to the invention as depicted in FIG. 4.

FIG. 1 represents a schematic side view of a double-twist bunching machine 11. This double-twist bunching machine 11 serves for bunching or twisting several individual strands 12 into a bunched strand material 14. By way of example, several individual wires are twisted into a wire strand. It is possible to process strand cross-sections ranging from for example 0.05 $mm^2$ to for example 70 $mm^2$.

The double-twist bunching machine 11 is preferably surrounded by an enclosure 16 which is provided for reasons of safety and for noise protection. Outside the enclosure 16 a storage space for spools, not shown, is provided which serves for providing and supplying individual strands 12 or multiple strands. Via an inlet 17, the individual strands 12 pass to a first deflection point 18. This first deflection point 18 comprises at least one first deflection roller 19 which is mounted to a machine frame 22 in a manner such that it can rotate about an axis of rotation 21. The axis of rotation 21 preferably corresponds to the supply axis of the inlet 17. The first deflection point 18 lodges one end of a bow 24 which is fixed, at an opposite end, to a second deflection point 26. Thus, the bow 24 is mounted in such a manner as to be rotatable about an axis of rotation 21. Such bows 24 are formed, for example, of carbon fibres or of composite materials and have several guide members 27 or rollers through which the individual strands are guided from the first deflection point 18 to the second deflection point 26. These guide members 27 are preferably arranged as ceramic guide elements that are replaceable on the bow 24.

The second deflection point 26 is realised in the form of a deflection device 31 which comprises at least one second deflection roller 32 by means of which the individual strands 12 may be guided out of the enclosure 16 via the outlet 34 as a bunched strand material 14. This second deflection device 31 is fixed to the machine frame 22 and is arranged so as to be rotatable about the axis of rotation 21.

Outside the enclosure 16, a spool 36 is arranged which is provided for taking up and storing the bunched strand material 14. In addition, a pull-off gearing 37 is preferably provided outside the enclosure 16 in order to ensure the guiding of the bunched strand material 14 out of the working range of the double-twist bunching machine 11. In addition, a laying device 38 may be arranged upstream of the spool 36 in order to ensure a uniform take-up of the bunched strand material 14 onto the driven spool 36. Alternatively, the spool 36 may be arranged in a traversing manner in order to ensure a uniform laying of the strand material to be received. In addition, an intermediate storage outside the enclosure 16 may be provided downstream of which a double winder with an automatic swapping device is arranged. Thus, a continuous processing with a flying swapping of the spools is made possible.

FIG. 2 is an enlarged representation of a first embodiment of the deflection device 31 shown in FIG. 1. This deflection device 31 comprises a main body 41 which is lodged in such a manner as to be rotatable about the axis of rotation 21 with respect to the machine frame 22 by means of a rotary bearing 42. On the main body 41, the second deflection roller 32 is rotatably mounted, such that it rotates about the second deflection point 26 in order to convey a second twist to the individual strands 12 supplied via the bow 24. This second deflection point 26 forms at the same time a pull-off point for the strand material 14 from the deflection roller 32. The supply of the individual strands 12 to the second deflection roller 26 takes place via a guide roller 44 which takes over, and deflects, the supplied individual strands 12 from the bow 24 in order to operate a change in the supply direction. Subsequently, the strand material is supplied to the deflection roller 32 at a supply point 33 and twines itself around the deflection roller 32, preferably in a range of between 75° and 285°. Thus it is possible to guide the strand material 14 out of the working range or range of rotation of the bow 24 after it has left the second deflection point 26. The bow 24 is releasably attached to the main body 41 with its second end.

In the main body 41, a through hole is provided into which the rotary bearing 42 is inserted. At one end disposed outside the main body 41 the rotary bearing 42 is rigidly connected to the machine frame 22. The rotary bearing 42 has a central through hole 43 which forms at least part of an outlet 34. Within the central through hole 43 at least one bunching die 46 is provided which is replaceable and through which the bunched strand material 14 is led and by which it is firmly held in place so as to be prevented from spontaneous untwisting. The bunching die 46 is replaceably arranged in the rotary bearing 42 and preferably abuts on a stop 47 in order to ensure a defined position and an automatic release from the rotary bearing 42. Furthermore, the at least one bunching die 46 may also be arranged outside the deflection device 31 as a separate member either within or outside the enclosure 16. In one way or the other, the embodiment according to FIG. 2 allows a particularly compact arrangement.

On the main body 41, a driving member 48 is attached on which a driving unit 49 for rotatably driving the main body 41 is applied.

FIG. 3 represents an alternative embodiment of a deflection device 31 which differs from that shown in FIG. 2. With this deflection device 31, the supplying of the individual strands 12 via the bow 24 is carried out in such a manner that after leaving the bow 24 the individual strands are directly deflected by the second deflection roller 32 and transferred to the outlet 34. Thus, a simplification in design may be achieved. In addition, one or several further guide rollers 51 may be provided in the end region of the bow 24 in order to ensure an accurate transition of the individual strands 12 to the second deflection roller 32. As to the rest, the explanations concerning the deflection device 31 according to FIGS. 1 and 2 may equally apply to the present case.

In a further embodiment, which represents an alternative to the bow 24 that may assume a differently curved shape depending on the rotational speed, a rigid frame or cage may be enabled to be provided for guiding the individual wires 12.

In addition, the spool 36 arranged outside the range of rotation of the bow 24 makes it possible for a device permitting the flying swapping of spools to be arranged downstream of the double-twist bunching machine 11. Alternatively, a storing unit may be provided outside the bunching machine 11 which permits the bunched strand material to be temporarily stored as the spools are being replaced, such that an uninterrupted operation of the bunching machine is enabled.

The arrangement of the spool 36 outside the range of rotation of the bow 24 ensures a high degree of flexibility of the double-twist bunching machine 11 concerning the diameters of the individual strands 12 and the strand cross-sections to be processed. In addition, it is also possible to work with different storage volumes of strand material.

FIG. 4 represents a schematic view of a further embodiment of a double-twist bunching machine 11 according to the invention. This embodiment differs from the embodiment described above in the configuration of the deflection device 31 and will be described in the following in greater detail. As for the rest, fully extensive reference is made to the preceding figures as far as the structure and the embodiments are concerned.

The deflection device 31 differs from the embodiment of FIGS. 1 and 2 in that it has not just one second deflection roller 32 but comprises at least one further deflection roller 55 which is assigned to the second deflection roller 32. The arrangement of the two deflection rollers 32, 55 and the way the strand material twines itself around them between the guide roller 44 and the bunching die 46 and/or the guiding of the bunched strand material 14 out of the deflection device 31 is represented in greater detail in FIG. 5.

In the working position of the bunching machine 11 represented in FIG. 4, a central axis of the deflection roller 32 is mirror-inverted with the longitudinal axis of the first deflection roller 19 with respect to the axis of rotation 21. This is to say that unlike the first embodiment of the axis of rotation 21, the second deflection roller 32 is arranged on an opposite side with respect to the first deflection roller 19. However, a second deflection point 26, which forms a pull-off point from the second deflection roller 32, is designed to be arranged in the axis of rotation 21. The further deflection roller 55 lies opposite the second deflection roller 32 on the other side of the axis of rotation 21. Thus, a distance or gap is formed between the second deflection roller 32 and the further deflection roller 55 which is crossed at a right angel by the axis of rotation 21. The two deflection rollers 32, 55 are preferably arranged parallel with each other. The deflection roller 32 and the further deflection roller 55 are preferably aligned at a right angle with respect to the axis of rotation 21. The distance between the two deflection rollers 32, 55 is preferably made to be small. The deflection rollers 32, 55 are preferably rotatably accommodated within the main body 41. They may be arranged or lodged therein in such a manner as to be easily replaced.

Upon leaving the bow 24, the strand material 14 is deflected via the guide roller 44 and supplied to the further deflection roller 55 at the supply point 33. This supply point 33 preferably lies in the space existing between the two deflection rollers 32, 55. Subsequently, the strand material twines itself around the deflection roller 55 by three quarters of a turn. The strand material 14 is then made to twine itself at least one time fully around both deflection rollers 32, 55. Subsequently, the strand material 14 twines itself one more time by another three quarters of a turn around the second deflection roller 32, before being guided out of the deflection device 31 at the second deflection point 26 or pull-off point and being pulled, for example, through the bunching die 46. The arrangement by which the twining around the rollers is carried out is designed to be such that the individual portions of the strand material 14 lie separate from each other, respectively, so that no friction between the individual portions of the strand material 14 will occur. Preferably, the deflection rollers 32, 55 may have grooves for guiding the strand material 14. In addition, one or both of the deflection rollers 32, 55 may be designed to be rotationally driven.

The longitudinal axes of the second deflection roller 32 and of the further deflection roller 55 lie in a common plane. This plane may be oriented both perpendicular to the axis of rotation 21 with respect to its first extension along the longitudinal axes and perpendicular to the axis of rotation with respect to its further extension, which connects said two longitudinal axes with each other. Alternatively, said plane may be designed to be arranged in an inclined manner, forming an angle with respect to the axis of rotation 21 relative to its further extension, which crosses said two longitudinal axes, as represented, for example, in FIG. 4.

The supply point 33 on the further deflection roller 55 is designed to be spaced apart from the pull-off point in the second deflection point 26 of the second deflection roller 32 by a distance I. This distance I, or lateral offset, is very much smaller as compared to the distance between the first deflection point 18 and the second deflection point 26, or, in other words, the distance between the first and second deflection points 18, 26 is by many times longer than the distance I between the supply point and the pull-off point of the strand material 14 in the deflection device 31 according to FIGS. 4 and 5.

In addition, as an alternative to the at least one full turn of the strand material twined between the second deflection roller 32 and the further deflection roller 55, as represented in FIG. 5, the strand material may be designed to respectively twine itself around each of the deflection rollers by only three quarters of a turn.

The type of twisting described in greater detail in connection with FIG. 5 may also be provided in an analogous manner in the embodiments of the double-twist bunching machine 11 according to FIGS. 2 and 3. For this purpose, instead of the deflection roller 32 described in FIGS. 2 and 3, a modified deflection roller 32 is used which has an outside circumference or a lateral surface provided with a circumferential, groove-like recess that is provided with a pitch. This groove-like recess thus extends on the circumferential surface in the manner of a screw thread or a worm. The groove-like recess is provided in such a manner that the strand material may be made to twine itself at least once fully around the circumferential surface. The pull-off point of the strand material on the second deflection point remains in the axis of rotation. The supplying of the strand material to be bunched thus occurs with an offset from the axis of rotation 21.

In the embodiment according to FIG. 2, in view of the utilisation of the modified, second deflection roller 32, the guide roller 44 arranged upstream thereof and the end of the bow 24 assigned to the guide roller 44 are designed to be laterally offset with respect to the second deflection point 26. This lateral offset corresponds at least to the distance necessary to make the strand material 14 twine itself one time fully around the second deflection roller 32, so that the strand material 14 may be pulled off exclusively when it is in the deflection point 26.

This above described arrangement is applicable, by analogy, to the embodiment of FIG. 3 when utilised with the modified deflection roller 32, with the bow 24 of this embodiment being simply arranged slightly offset from the axis of rotation 21 of the strand material 14 to be bunched.

Depending on the number and the diameter of the individual strands to be bunched into a strand material 14, it is possible to make the strand material twine itself around the rollers either one time or several times by a full turn, such that the second deflection roller 32 may be adapted correspondingly. Depending on this, the eccentric offset of the bow 24 and/or of the guide roller 44 may furthermore be effected in order to allow the strand material 14 which is to be bunched to be supplied in an essentially rectilinear manner to the second deflection roller 32.

Any one of the characteristics mentioned above is in itself relevant with regard to the invention and they may be capable of being combined with one another without restriction.

The invention claimed is:

1. A double-twist bunching machine for fabricating bunched strand material having an inlet for individual strands which are supplied to a first deflection point that has a first deflection roller, the first deflection roller being arranged so as to be rotatable around an axis of rotation for forming a first twist, a bow rotating about the axis of rotation and connecting the first deflection point with a second deflection point, the second deflection point having at least one second deflection roller that is rotatable about the axis of rotation for forming a second twist, and a spool onto which the bunched strand material is wound and which is arranged outside the range of rotation of the bow, wherein the second deflection roller and at least one further deflection roller, which is assigned to the second deflection roller, form a deflection device mounted in pairs in a manner such that they can rotate about the axis of rotation, and wherein a supply point for the strand material is provided on the further deflection roller which lies between the second and the at least one further deflection rollers, and a pull-off point of the strand material is provided on the second deflection roller which lies in the second deflection point on the axis of rotation, and wherein the strand material after having passed the supply point of the further deflection roller twines itself and is supplied to the second deflection roller, the strand material crossing the supply direction to the supply point and twining itself subsequently around the second deflection roller, such that the strand material is guided out of the deflection device at the second deflection point.

2. The double-twist bunching machine of claim 1, wherein the second and the at least one further deflection rollers are aligned parallel with each other.

3. The double-twist bunching machine of claim 1, wherein the longitudinal axes of the second and the at least one further deflection rollers are perpendicular to the axis of rotation.

4. The double-twist bunching machine of claim 1, wherein between the supply point and the second deflection point the bunched strand material is guided in such a manner that it twines itself at least once, by a full twist, around the second deflection roller and the at least one further deflection roller.

5. The double-twist bunching machine of claim 1, wherein the deflection device comprises a guide roller which is laterally offset with respect to the axis of rotation and supplies the strand material to the supply point of the at least one further deflection roller, which is offset from the axis of rotation.

6. A double-twist bunching machine for fabricating bunched strand material, having an inlet for individual strands which may be are supplied to a first deflection point that has a first deflection roller, the first deflection roller being arranged so as to be rotatable around an axis of rotation for forming a first twist, a bow rotating about the axis of rotation and connecting the first deflection point with a second deflection point, the second deflection point having at least one second deflection roller that is rotatable about the axis of rotation for forming a second twist, and a spool onto which the bunched strand material is wound and which is arranged outside the range of rotation of the bow, wherein in the second deflection point a deflection device having a second deflection roller is provided which rotates about the axis of rotation and has a pull-off point of the strand material from the second deflection roller which lies in the deflection point, and wherein the first and second deflection rollers are arranged between the bow and the axis of rotation and wherein the second deflection roller is provided with a circumferential, groove-shaped recess having a pitch so as to allow the strand material to twist itself at least once fully around the roller.

7. The double-twist bunching machine of claim 6, wherein the deflection device has at least one further guide roller which is arranged between one end of the bow assigned to the deflection device and the second deflection roller.

8. The double-twist bunching machine of claim 6, wherein the end of the bow facing to the deflection device and the second deflection roller in the deflection device are arranged in such a manner that the bunched strand material upon leaving the bow is directly supplied to the second deflection roller and is guided out of the range of rotation of the bow via the second deflection roller.

9. The double-twist bunching machine of claim 6, wherein the deflection device has an outlet which lies in the axis of rotation of the first and second deflection points.

10. The double-twist bunching machine of claim 6, wherein the deflection device has a main body which accommodates at least the second deflection roller and on which one end of the bow is releasably attached.

11. The double-twist bunching machine of claim 6, wherein the deflection device has a rotary bearing by which the main body is accommodated in such a manner as to be rotatable about the axis of rotation.

12. The double-twist bunching machine of claim 6, characterised in that wherein in the outlet, a bunching die, slide block, or guide bush is provided in such a manner as to be secured against rotation.

13. The double-twist bunching machine of claim 12, wherein the bunching die is provided so as to be replaceable in the rotary bearing and is positioned against a stop.

14. The double-twist bunching machine of claim 6, wherein on a main body of the deflection device a driving member is provided on which a driving unit for rotatably driving the main body is applied.

15. The double-twist bunching machine of claim 11, wherein the rotary bearing comprises a through hole through which the bunched strand material is guided out of the range of rotation of the bow and drawn towards the outside.

16. The double-twist bunching machine of claim 1, wherein the deflection device has an outlet which lies in the axis of rotation of the first and second deflection points.

17. The double-twist bunching machine of claim 1, wherein the deflection device has a main body which accommodates at least the second deflection roller and on which one end of the bow is releasably attached.

18. The double-twist bunching machine of claim 1, wherein the deflection device has a rotary bearing by which the main body is accommodated in such a manner as to be rotatable about the axis of rotation.

19. The double-twist bunching machine of claim 18, wherein the rotary bearing comprises a through hole through which the bunched strand material is guided out of the range of rotation of the bow and drawn towards the outside.

20. The double-twist bunching machine of claim 1, wherein in the outlet, a bunching die, slide block, or guide bush is provided in such a manner as to be secured against rotation.

21. The double-twist bunching machine of claim 1, wherein on a main body of the deflection device a driving member is provided on which a driving unit for rotatably driving the main body is applied.

22. The double-twist bunching machine of claim 1, wherein the deflection device has an outlet which lies in the axis of rotation of the first and second deflection points.

* * * * *